US005313181A

United States Patent [19]

Negus

[11] Patent Number: 5,313,181

[45] Date of Patent: May 17, 1994

[54] MAGNETIC SOCKET HOLDER

[75] Inventor: Joel A. Negus, Clarinda, Iowa

[73] Assignee: Lisle Corporation, Clarinda, Iowa

[21] Appl. No.: 1,534

[22] Filed: Jan. 7, 1993

[51] Int. Cl.[5] ..... H01F 7/20; A45F 5/00

[52] U.S. Cl. ..... 335/285; 224/183; 206/818; 206/350; 269/8

[58] Field of Search ..... 335/285, 286, 295, 302, 335/306; 206/564, 818, 350; 223/109 A; 224/183; 81/24; 7/901; 269/8; 279/128; 29/810

[56] References Cited

U.S. PATENT DOCUMENTS

| | | | |
|---|---|---|---|
| D.157,115 | 7/1948 | Zumpe | 206/564 |
| 1,712,473 | 5/1929 | McWethy . | |
| 2,217,514 | 10/1940 | Henry | 65/13 |
| 2,457,421 | 12/1948 | Warren | 175/367 |
| 2,904,364 | 9/1959 | Korodi | 335/285 |
| 3,059,767 | 10/1959 | Chalfin | 206/818 |
| 3,212,546 | 10/1965 | Lind | 150/40 |
| 3,405,377 | 10/1968 | Pierce | 335/385 |
| 3,481,462 | 12/1969 | Chapel | 206/63.2 |
| 3,726,393 | 4/1973 | Thompson | 206/16 |
| 4,043,453 | 8/1977 | Greenlee | 206/349 |
| 4,174,037 | 11/1979 | Chow | 206/378 |
| 4,337,860 | 7/1982 | Carrigan | 206/376 |
| 4,353,465 | 10/1982 | Rado | 206/378 |
| 4,405,108 | 9/1983 | Muirhead | 248/206 |
| 4,408,753 | 10/1983 | Chapman | 269/8 |
| 4,421,230 | 12/1983 | Stanton | 206/378 |
| 4,482,049 | 11/1984 | Kott, II | 206/379 |
| 4,591,817 | 5/1986 | Miller | 335/285 |
| 4,622,738 | 11/1986 | DeLucchi | 211/70 |
| 4,711,353 | 12/1987 | Rozmestor | 206/378 |
| 4,802,580 | 2/1989 | Andersen | 206/378 |
| 5,080,230 | 1/1992 | Winnard | 206/350 |
| 5,203,469 | 4/1993 | Change | 220/331 |

FOREIGN PATENT DOCUMENTS

| | | | |
|---|---|---|---|
| 949040 | 9/1956 | Fed. Rep. of Germany . | |
| 1216548 | 11/1958 | France | 206/818 |
| 697995 | 10/1953 | United Kingdom . | |

OTHER PUBLICATIONS

Mechanics Time Saver, Inc., brochure dated Sep., 1992 entitled, "Problem? Solution!".

*Primary Examiner*—Leo P. Picard
*Assistant Examiner*—Stephen T. Ryan
*Attorney, Agent, or Firm*—Allegretti & Witcoff, Ltd.

[57] ABSTRACT

A magnetic socket holder includes a molded plastic tray with a center bar having laminated keeper plates and bar magnets positioned therein to define pole pieces which permit the forming of magnetic circuits that when closed enhance the holding action of sockets in the tray, as well as holding action of the tray on a magnetizable surface.

11 Claims, 2 Drawing Sheets

MAGNETIC SOCKET HOLDER

BACKGROUND OF THE INVENTION

This invention relates to a magnetic socket holder and, more particularly, to a magnetic socket holder which utilizes a single closed loop magnetic circuit to hold each individual socket positioned in the holder and a plurality of such circuits to provide a means for mounting the socket holder on a magnetizable surface.

Heretofore, there have been various constructions combining a molded, non-magnetic material with magnets to thereby provide a holder for metal sockets. Pierce, U.S. Pat. No. 3,405,377, discloses such a construction which includes a series of parallel bores in a non-magnetic material. A magnet is positioned at the bottom of each bore and arranged so that a magnetic circuit is completed by insertion of a socket in the bore. Miller, in U.S. Pat. No. 4,591,817, discloses a socket holder which includes armatures or plates that laminate a magnetic material to thereby define an assembly for holding sockets. Anderson, in U.S. Pat. No. 4,802,580, discloses a similar construction wherein parallel plates sandwich a magnetic material. A third, parallel plate is positioned to facilitate alignment of the items being retained. Each of these references is incorporated herewith by reference.

While the above-identified constructions are quite useful and provide a means for storing metal sockets in a convenient and easily accessible fashion, there has remained a need for an improved apparatus for storing and maintaining sockets made of a magnetizable material.

SUMMARY OF THE INVENTION

Briefly, the present invention comprises an improved magnetic socket holder fabricated from a molded tray of non-magnetic material in combination with a pair of bar magnets laminated with pole pieces or armatures. The bar magnets are arranged along a center rib in the molded tray. One of the bar magnets serves as a source of magnetism for holding the sockets in the tray by magnetizing the keeper plates which are positioned to complete a single magnetic circuit with each socket. The second bar magnet is fabricated to provide a plurality of magnetic circuits designed to hold the tray itself on a magnetizable surface.

Thus, it is an object of the invention to provide an improved magnetic socket holder.

A further object of the invention is to provide a magnetic socket holder which is easily assembled and economical to manufacture.

Another object of the invention is to provide a magnetic socket holder which utilizes one or more bar type magnets in combination with a non-magnetic molded tray to provide a holder for sockets of a magnetizable material.

Still another object of the invention is to provide an improved magnetic socket holder which may be easily attached in any desired orientation to a magnetizable surface while retaining sockets tightly in the holder and providing ease of access to the sockets.

Yet another object of the invention is to provide an improved magnetic socket holder which utilizes magnetic circuits in a unique manner to retain both the sockets individually in the holder and to mount the holder itself on a magnetizable surface.

These and other objects, advantages and features of the invention will be set forth in the detailed description which follows.

BRIEF DESCRIPTION OF THE DRAWINGS

In the detailed description which follows reference will be made to the drawing comprised of the following figures.

DESCRIPTION OF THE PREFERRED EMBODIMENT

Figure 1:
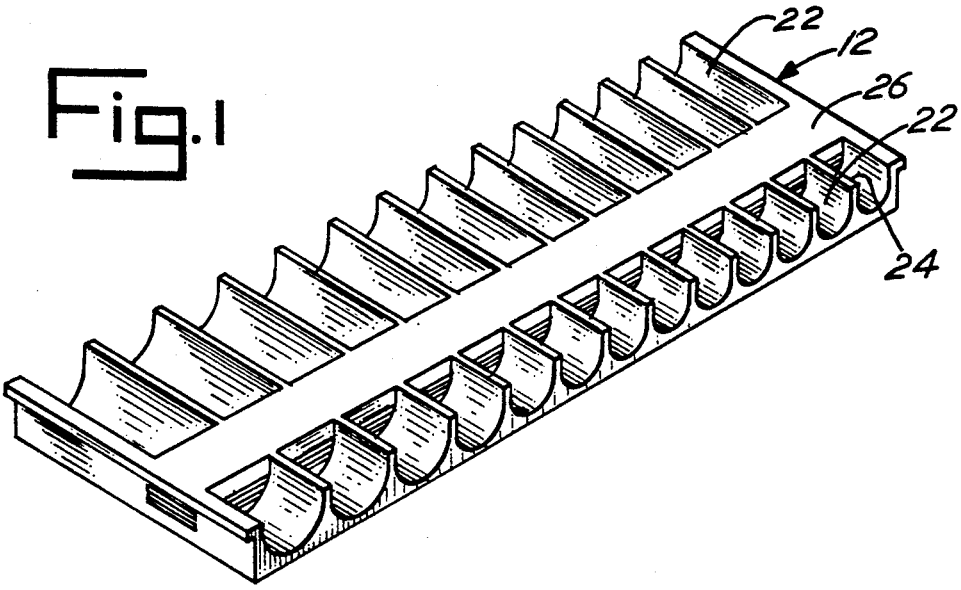
FIG. 1 is a perspective view of the improved magnetic socket holder of the invention.

Referring to the figures, the improved socket holder of the present invention is comprised of a molded tray 12 in combination with a first pole piece, armature, or keeper 14, a bar magnet 16, a second pole piece, armature, or keeper 18 and a second bar magnet 20. The tray 12 is molded from a non-magnetic material, for example, plastic material, and includes a series of parallel troughs 22 which are separated by ridges 24 and extend transversely from a molded, hollow center rib or member 26. Each trough 22 is sized to receive magnetizable sockets having a range of dimension and shape. In a preferred embodiment of the invention, troughs 22 extend transversely from both sides of the center member 26 to accommodate sockets of various length and size and, further, to increase the capacity of the socket holder.

The magnets 16 and 20 and pole pieces 14 and 18 are fitted into a hollow, longitudinal recess 30 molded in the tray 12 along or within the center rib 26. Thus, the magnet 16 is laminated between keepers 14 and 18. Magnet 20 is attached to keeper 18. The tray 20 includes a bottom surface 32. The second magnet 20 includes a lower surface 34 which is generally coplanar with the bottom surface 32 of the tray 12.

Figure 4:
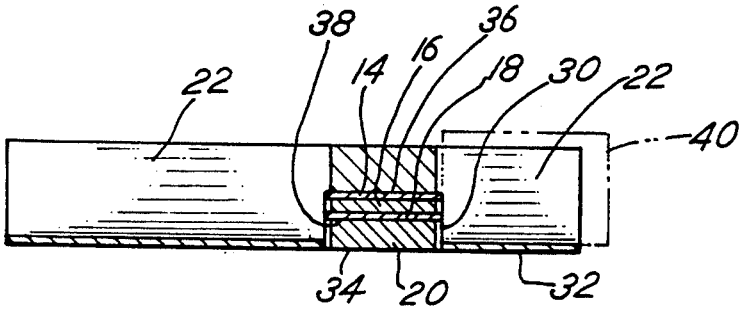
FIG. 4 is a sectional view of the socket holder of FIG. 3 taken along the lines 4—4.
Figure 5:
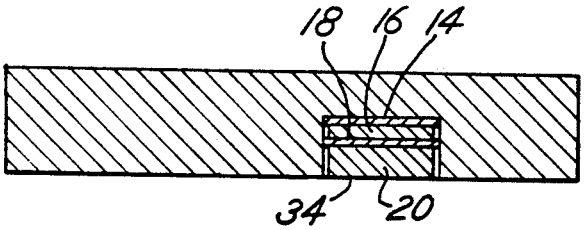
FIG. 5 is a sectional view of the holder of FIG. 3 taken along the lines 5—5.

The magnet 16 includes an upper surface 36 against which the keeper 14 is positioned. The magnet 16 includes a lower surface 38 against which the keeper 18 is positioned. It is to be noted that the magnet 16 is an elongated magnet which extends the length of the tray and has a width dimension (as depicted in FIG. 4) which is slightly less than the width dimension of the keeper plates 14 and 18. This is an important feature of the preferred embodiment of the invention inasmuch as the keeper plates 14 and 18 have distinct polarity and project very slightly into each trough 22. By so projecting, the keeper plates 14 and 18 cooperate and engage with each socket 40 to define a closed magnetic circuit.

Figure 6:
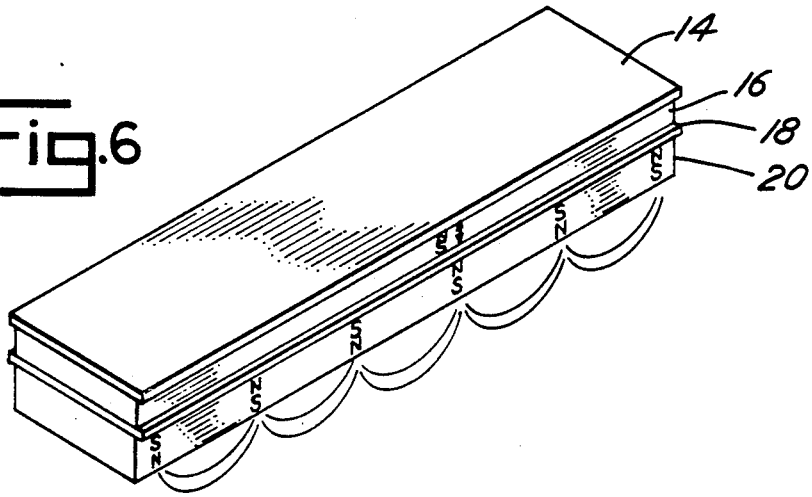
FIG. 6 is a perspective view of the configuration of the bar magnets and keeper plates or armatures incorporated with the socket holder of the invention.
Figure 2:
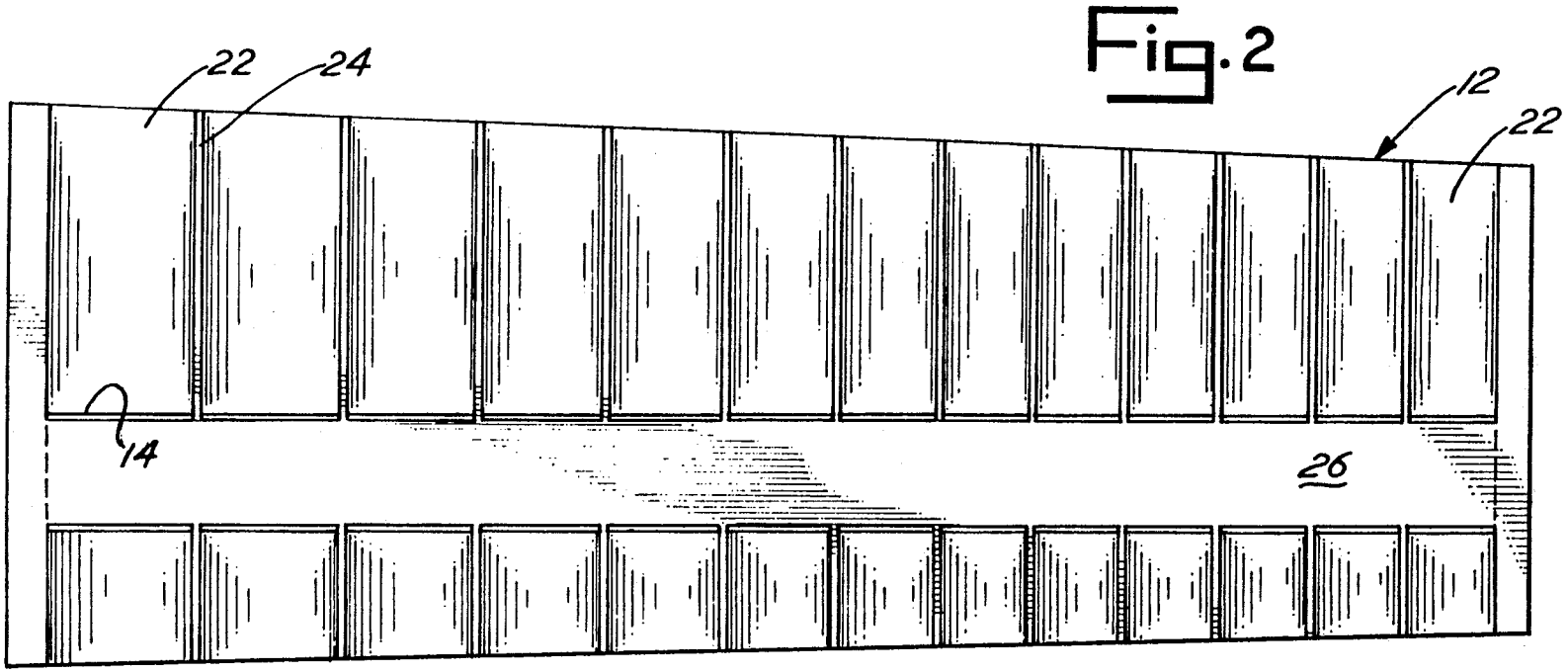
FIG. 2 is a top plan view of the socket holder of FIG. 1.
Figure 3:
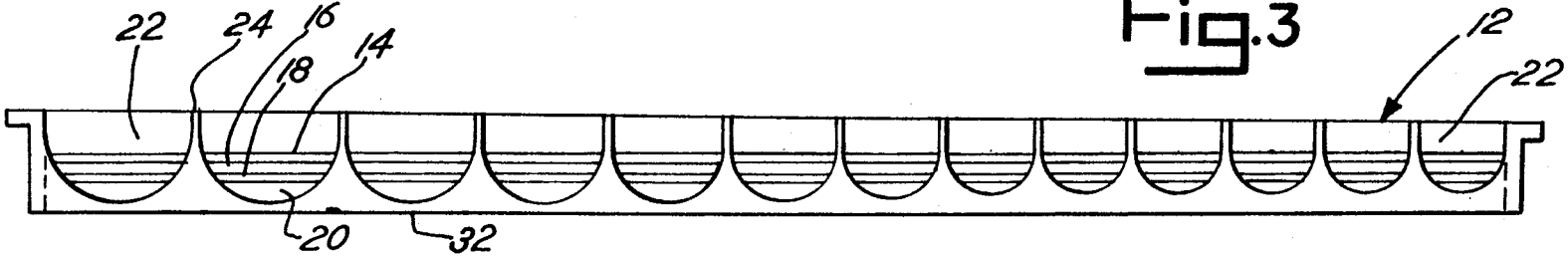
FIG. 3 is a side elevation view of the socket holder of FIG. 1.

That is, as depicted in FIG. 6, the top surface 36 of the magnet 16 has a first polarity, for example, a north pole polarity. The bottom surface 38 of the magnet 16 has a second polarity, for example a south pole polarity. The armatures or pole pieces or keeper plates 14 and 18, respectively are associated with distinct polarities. Thus when contacted with a socket, for example, socket 40 they provide for a closed magnetic circuit which more efficiently and more effectively holds the socket 40 in position in trough 22. All of the troughs 22 and the keepers 14, 18 thus cooperate with sockets 40 in the manner described. Note one pair of keepers 14, 18 serves to cooperate with all sockets 40 in all troughs 22 on both sides of rib 26.

The second magnet 20, as will be seen by reference to FIG. 6, includes a plurality of poles along the region of its bottom surface 34. Of course, a plurality of poles of opposite polarity are provided along the region of the top of the magnet 20 as depicted in FIG. 6. The pole piece 18 serves to connect or close the circuits of the magnet 20 along its top surface. The bottom surface of magnet 20 may therefore be positioned on a magnetic surface, for example a sheet metal iron surface, to complete a plurality of magnetic circuits along that surface. Because there are a plurality of north and south poles along the bottom surface of the magnet 20, the number of magnetic circuits and the strength of attachment of the tray and the holding force associated with holding the tray in position is greatly enhanced. The array of the polarity of the magnets 16 and 20 thus facilitates holding the sockets 40 in position as well as holding of the tray 12 onto a magnetizable surface.

It is possible to vary the construction of the tray. For example, rather than having a single bar magnet running the length of the center rib 26, separate magnets may be associated with each of the troughs 22. Similarly, separate magnets may be utilized in place of the bar magnet 20. Additionally, the magnetic material used to manufacture the magnets 16 and 20 may be varied. For example, it may be a composite elastomeric material such as taught in U.S. Pat. No. 4,591,817 reference above. Magnets 16 and 20 may be replaced by a single magnet. The magnet 20 may be omitted. The array of the troughs 22 may also be varied. It is an object of the invention, however, to enhance the holding power with respect to sockets 40 by means of completing magnetic circuits in a desirable fashion. Thus, the invention is to be limited only by the following claims and their equivalents.

What is claimed is:

1. An improved magnetic socket holder comprising, in combination:

a non-magnetic material tray including a plurality of generally parallel troughs, the top of each trough being open to receive a socket, said tray including a transverse magnet support channel abutting one end of each trough, said channel being open at said one end of each trough; and a first magnet in the magnet support channel, said first magnet having a top surface and a bottom surface, a longitudinal dimension generally transverse to said one end of the trough, said first magnet extending across the said one end of all the troughs, said first magnet having one pole along the top surface and another pole along the bottom surface whereby a socket of magnetically responsive material in any trough will bridge the poles and form a closed magnetic circuit.

2. The holder of claim 1 including a pole piece for each pole, said pole pieces laminating the magnet and projecting into the troughs to define magnetic field pathways for a socket abutting the pole pieces in each trough.

3. The holder of claim 1 including a second magnet mounted in the holder, generally parallel to the first bar magnet, said second magnet having a top face and a bottom face, the bottom face being positioned generally in a mounting surface to the socket holder, said bottom face defining a multiplicity of different poles along the length of the second magnet whereby the holder may be mounted on a magnetizable surface by means of the second magnet in combination with the magnetizable surface defining a plurality of magnetic circuits.

4. The holder of claim 3 including a pole piece for each pole of the first magnet and a pole piece for the top surface of the second magnet.

5. The holder of claim 4 wherein the pole piece on the bottom surface of the first magnet also comprises the pole piece for the second magnet.

6. The improved holder of claim 1 wherein the magnet is a bar magnet.

7. The improved holder of claim 3 wherein the magnets are both bar magnets.

8. The improved holder of claim 1 including troughs extending in opposite directions from the magnet.

9. The improved holder of claim 1 wherein the tray is a molded tray.

10. An improved magnetic socket holder comprising in combination:

a molded socket tray including a mounting surface, a tray cross member, a plurality of parallel troughs extending from the tray cross member, each trough being separated from the next adjacent trough by a rib, each trough being sized to receive a socket, said tray cross member including a magnet support channel which is open to the troughs;

a first magnet mounted in the support channel, said first magnet including a first surface region of one polarity and a second separate surface region of another polarity, a first keeper plate mounted on the first surface region, said first keeper plate projecting into the troughs; and a second keeper plate mounted on the second surface region, said second keeper plate also projecting into the troughs, whereby the plates are positioned to engage a socket in each trough to thereby complete a magnetic circuit through the projecting pole pieces.

11. The holder of claim 10, further including a second magnet mounted in the molded socket tray, said second magnet also including a mounting surface generally coplanar with the holder mounting surface, said second magnet including a plurality of pole regions in its mounting surface whereby placing the second magnet mounting surface of a magnetizable surface will define a plurality of magnet circuits.

* * * * *